US011621121B2

(12) United States Patent
Shimoda et al.

(10) Patent No.: US 11,621,121 B2
(45) Date of Patent: Apr. 4, 2023

(54) INDUCTOR COMPONENT

(71) Applicant: Murata Manufacturing Co., Ltd., Kyoto-fu (JP)

(72) Inventors: Yuta Shimoda, Nagaokakyo (JP); Shinya Tajima, Nagaokakyo (JP); Yasunari Nakashima, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 330 days.

(21) Appl. No.: 16/942,461

(22) Filed: Jul. 29, 2020

(65) Prior Publication Data

US 2021/0043371 A1 Feb. 11, 2021

(30) Foreign Application Priority Data

Aug. 7, 2019 (JP) ..... JP2019-145556

(51) Int. Cl.
*H01F 5/00* (2006.01)
*H01F 27/32* (2006.01)
(Continued)

(52) U.S. Cl.
CPC ..... *H01F 27/323* (2013.01); *H01F 27/02* (2013.01); *H01F 41/122* (2013.01)

(58) Field of Classification Search
CPC ..... H01F 27/323
(Continued)

(56) References Cited

U.S. PATENT DOCUMENTS 11,133,129 B2 * 9/2021 Lee ..... H01F 17/04
11,315,724 B2 * 4/2022 Park ..... H01F 27/292
(Continued)

FOREIGN PATENT DOCUMENTS

CN 107785153 A 3/2018
JP 2004-031833 A 1/2004
(Continued)

OTHER PUBLICATIONS

An Office Action; "Notice of Reasons for Refusal," mailed by the Japanese Patent Office dated Mar. 29, 2022, which corresponds to Japanese Patent Application No. 2019-145556 and is related to U.S. Appl. No. 16/942,461 with English language translation.
An Office Action mailed by China National Intellectual Property Administration dated Jan. 18, 2022, which corresponds to Chinese Patent Application No. 202010782973.0 and is related to U.S. Appl. No. 16/942,461 with English language translation.

*Primary Examiner* — Ronald Hinson
(74) *Attorney, Agent, or Firm* — Studebaker & Brackett PC

(57) ABSTRACT

An inductor component includes an element assembly having a first surface and a second surface located opposite to the first surface, a first direction-distinguishing layer disposed on the first surface, and a second direction-distinguishing layer disposed on the second surface. The first direction-distinguishing layer has a first cavity passing through in the thickness direction. The second direction-distinguishing layer has a second cavity passing through in the thickness direction. The element assembly has a first exposed portion that is part of the element assembly and that is exposed in the first cavity and has a second exposed portion that is part of the element assembly and that is exposed in the second cavity. The first amount of protrusion of the first exposed portion protruding in the thickness direction is less than the second amount of protrusion of the second exposed portion protruding in the thickness direction.

20 Claims, 4 Drawing Sheets

(51) Int. Cl.
*H01F 41/12* (2006.01)
*H01F 27/02* (2006.01)

(58) Field of Classification Search
USPC ..... 336/200
See application file for complete search history.

(56) References Cited

U.S. PATENT DOCUMENTS

| | | | | |
|---|---|---|---|---|
| 11,495,391 | B2 * | 11/2022 | Song | H01F 27/2804 |
| 2016/0086727 | A1 * | 3/2016 | Choi | H01F 17/0013 336/200 |
| 2016/0163442 | A1 * | 6/2016 | Yoon | H01F 27/085 336/200 |
| 2016/0268038 | A1 * | 9/2016 | Choi | H01F 27/255 |
| 2016/0268047 | A1 * | 9/2016 | Shin | H01G 4/232 |
| 2018/0047498 | A1 * | 2/2018 | Nakashima | H01F 17/0013 |
| 2018/0061551 | A1 | 3/2018 | Kondou et al. | |
| 2018/0096783 | A1 * | 4/2018 | Fukuda | H01F 27/366 |
| 2019/0096569 | A1 * | 3/2019 | Tanabe | H01F 41/041 |
| 2019/0115127 | A1 | 4/2019 | Iso et al. | |
| 2019/0189338 | A1 * | 6/2019 | Kim | H01F 17/0013 |
| 2019/0333679 | A1 * | 10/2019 | Lee | H01F 27/327 |
| 2020/0020477 | A1 * | 1/2020 | Kang | H01F 17/0013 |

FOREIGN PATENT DOCUMENTS

| | | | |
|---|---|---|---|
| JP | 2006-108383 | A | 4/2006 |
| JP | 2011-014940 | A | 1/2011 |
| JP | 2014-072507 | A | 4/2014 |
| JP | 2019-075401 | A | 5/2019 |

* cited by examiner

INDUCTOR COMPONENT

CROSS-REFERENCE TO RELATED APPLICATION

This application claims benefit of priority to Japanese Patent Application No. 2019-145556, filed Aug. 7, 2019, the entire content of which is incorporated herein by reference.

BACKGROUND

Technical Field

The present disclosure relates to an inductor component.

Background Art

An inductor component is described in Japanese Unexamined Patent Application Publication No. 2011-14940. This inductor component includes an element assembly having a first end surface and a second end surface located opposite to the first end surface and outer electrodes disposed on the first end surface and the second end surface. The element assembly further has a first side surface (first surface) located perpendicularly to the first end surface and the second end surface, and a second side surface (second surface) located opposite to the first side surface, a third side surface located perpendicularly to the first end surface, the second end surface, the first side surface, and the second side surface, and a fourth side surface located opposite to the third side surface. A direction-distinguishing layer is disposed on the entire surface of each of the first side surface and the second side surface. The color of the direction-distinguishing layer is different from the color of the third side surface and the fourth side surface. Regarding this inductor component, the mounting direction of the inductor component is visually distinguished on the basis of difference in color.

It was found that the above-described inductor component had the following problems.

The direction-distinguishing layer is disposed on the entire surface of each of the first side surface and the second side surface, and neither the first side surface nor the second side surface is exposed outside the inductor component. Consequently, for example, during use of the inductor component, the direction-distinguishing layer disposed between the element assembly and the outside of the inductor component interferes with heat generated inside the element assembly and there is a problem of the heat being not efficiently dissipated outside the inductor component.

Meanwhile, to distinguish the direction-distinguishing layers disposed on the first side surface and the second side surface from each other, the direction-distinguishing layers are differentiated from each other in terms of lightness by changing the amount of an additive added. To make a difference in the lightness, two direction-distinguishing layers have to be formed of materials having different compositions at much expense in time and effort.

As described above, it is difficult for the inductor component to have an excellent heat dissipation effect while direction distinguishability is readily improved.

SUMMARY

Accordingly, the present disclosure provides an inductor component having an excellent heat dissipation effect while direction distinguishability is readily improved.

According to preferred embodiments of the present disclosure, an inductor component includes an element assembly having a first surface and a second surface located opposite to the first surface, a first direction-distinguishing layer disposed on the first surface, and a second direction-distinguishing layer disposed on the second surface. The first direction-distinguishing layer has a first cavity passing through the first direction-distinguishing layer in the thickness direction, and the second direction-distinguishing layer has a second cavity passing through the second direction-distinguishing layer in the thickness direction. The element assembly has, on the first surface, a first exposed portion that is part of the element assembly and that is exposed in the first cavity and has, on the second surface, a second exposed portion that is part of the element assembly and that is exposed in the second cavity. The first amount of protrusion of the first exposed portion protruding in the thickness direction of the first direction-distinguishing layer is less than the second amount of protrusion of the second exposed portion protruding in the thickness direction of the second direction-distinguishing layer.

In the present specification, the first amount of protrusion includes 0 or a negative value.

According to the above-described aspect, the element assembly has, on the first surface, a first exposed portion that is exposed in the first cavity and has, on the second surface, a second exposed portion that is exposed in the second cavity. Since part of the element assembly is exposed to the outside through each of the first cavity and the second cavity as described above, heat generated inside the element assembly can be efficiently dissipated to the outside during, for example, use of the inductor component. Consequently, the inductor component has an excellent heat dissipation effect.

Meanwhile, the first amount of protrusion of the first exposed portion protruding in the thickness direction of the first direction-distinguishing layer is less than the second amount of protrusion of the second exposed portion protruding in the thickness direction of the second direction-distinguishing layer. In this manner, the element assembly has the first exposed portion and the second exposed portion that have different amounts of protrusion. Therefore, two direction-distinguishing layers can be visually distinguished with ease and with reliability. As a result, two direction-distinguishing layers that can be visually distinguished from each other can be formed even when, for example, the materials have the same composition. Consequently, the direction distinguishability of the inductor component can be readily improved.

As described above, the inductor component has an excellent heat dissipation effect while direction-distinguishability can be readily improved.

Other features, elements, characteristics and advantages of the present disclosure will become more apparent from the following detailed description of preferred embodiments of the present disclosure with reference to the attached drawings.

DETAILED DESCRIPTION

Figure 1:
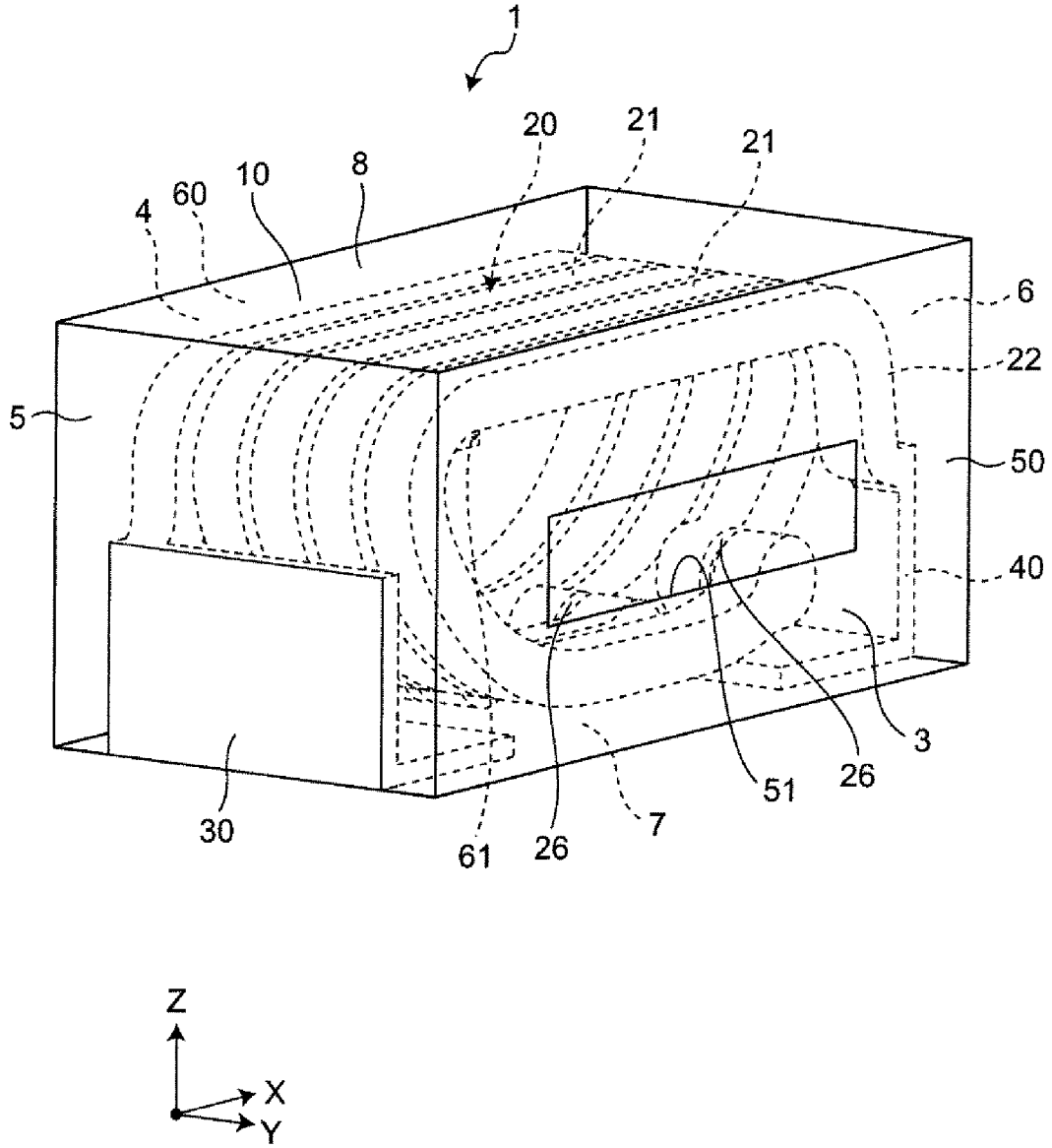
FIG. 1 is a transparent perspective view showing a first embodiment of an inductor component according to an aspect of the present disclosure.

An inductor component according to an aspect of the present disclosure will be described below in detail with reference to the embodiments shown in the drawings. In this regard, some drawings are schematic, and actual dimensions and ratios are not limited to being reflected.

First Embodiment

FIG. 1 is a transparent perspective view showing a first embodiment of an inductor component. As shown in FIG. 1, the inductor component 1 includes an element assembly 10, a first direction-distinguishing layer 50 having a first cavity 51 at which part of the element assembly 10 is exposed, and a second direction-distinguishing layer 60 having a second cavity 61 at which part of the element assembly 10 is exposed. The inductor component 1 further includes a spiral coil 20 disposed inside the element assembly 10 and a first outer electrode 30 and a second outer electrode 40 that are electrically coupled to the coil 20 disposed in the element assembly 10.

The inductor component 1 (first outer electrode 30 and second outer electrode 40) is electrically coupled to wiring lines of a circuit board (not shown) by, for example, solder (not shown). The inductor component 1 is used as, for example, an impedance matching coil (matching coil) of a high-frequency circuit and is used for electronic equipment, for example, personal computers, DVD players, digital cameras, televisions, cellular phones, car electronics, medical devices, and industrial devices. However, applications of the inductor component 1 are not limited to these, and the inductor component 1 may also be used for, for example, tuning circuits, filter circuits, and rectifier smoothing circuits.

The outer surface of the inductor component 1 is composed of a first side surface 3, a second side surface 4 located opposite to the first side surface 3, a first end surface 5 connected between the first side surface 3 and the second side surface 4, a second end surface 6 located opposite to the first end surface 5, a bottom surface 7 connected between the first end surface 5 and the second end surface 6, and a top surface 8 located opposite to the bottom surface 7. As shown in the drawing, the X-direction is a direction substantially normal to the first end surface 5 and the second end surface 6. The Y-direction is a direction substantially normal to the first side surface 3 and the second side surface 4. The Y-direction is the same direction as the thickness direction of the first direction-distinguishing layer 50 and the thickness direction of the second direction-distinguishing layer 60. The Z-direction is a direction substantially normal to the bottom surface 7 and the top surface 8. The X-direction, the Y-direction, and the Z-direction are orthogonal to each other. Regarding the element assembly 10, for example, the X-direction dimension is about 0.4 mm, the Y-direction dimension is about 0.2 mm, and the Z-direction dimension is about 0.2 mm The element assembly 10 is formed into a substantially rectangular parallelepiped. The element assembly 10 has a first surface 12 and a second surface 13 located opposite to the first surface 12. The element assembly 10 is, for example, a sintered body or a resin body. For example, in the case in which the insulating layer base material described later is an inorganic material and the element assembly 10 is produced by sintering, the element assembly 10 is a sintered body. When the element assembly 10 is the sintered body, the element assembly 10 is obtained by sintering after part of the surface of the element assembly 10 is exposed to air before sintering. Consequently, gases (specifically, organic materials contained in the element assembly 10 before sintering, decomposition products thereof, oxidation products thereof, and the like) generated during sintering are readily released, and degreasing performance is improved. Further, a heat dissipation effect during sintering is excellent.

Meanwhile, for example, in the case in which the insulating layer base material described later is a resin, the element assembly 10 is a resin body. In such a case, the heat dissipation effect is improved, and in actual use, a temperature increase of a product provided with the inductor component is hindered and deterioration of the product is suppressed from occurring.

The first outer electrode 30 and the second outer electrode 40 are composed of a conductive material, for example, Ag, Cu, or Au, and glass particles. The first outer electrode 30 is substantially in the shape of, for example, the letter L and is disposed over the first end surface 5 and the bottom surface 7. The second outer electrode 40 is substantially in the shape of, for example, the letter L and is disposed over the second end surface 6 and the bottom surface 7. The first outer electrode 30 is composed of a plurality of outer electrode conductive layers that are stacked in face-to-face contact with each other. The second outer electrode 40 is composed of a plurality of outer electrode conductive layers that are stacked in face-to-face contact with each other.

The coil 20 is composed of, for example, the same conductive material and glass particles as in the first outer electrode 30 and the second outer electrode 40. The coil 20 is spirally wound in the Y-direction. That is, the coil 20 has a winding axis (center axis) in the thickness direction of the first direction-distinguishing layer 50. A first end of the coil 20 is connected to the first outer electrode 30 through the extended electrode 22, and a second end of the coil 20 is connected to the second outer electrode 40 through the extended electrode 22. In this regard, in the present embodiment, the coil 20, the extended electrodes 22, the first outer electrode 30, and the second outer electrode 40 are integrated without distinct boundaries. However, boundaries are not limited to being indistinct and may be more prominently defined by the coil and the outer electrodes being formed of different materials or by different methods. Meanwhile, the first outer electrode 30, the second outer electrode 40, the extended electrode 22, and the coil 20 may contain no glass particles. The extended electrode 22 may be composed of a plurality of extended electrode conductor layers that are stacked in face-to-face contact with each other.

The coil 20 is formed into substantially the shape of an ellipse when viewed in the axis direction, but the shape is not limited to this. Examples of the shape of the coil 20 include substantially a circle, an ellipse, a rectangle, and other polygons. The axis direction of the coil 20 denotes the direction of the center axis of the spiral of the wound coil 20. In the present specification, "parallel" is not limited to a strictly parallel relationship and includes a substantially parallel relationship in consideration of a practical range of variations.

The coil 20 includes a coil wiring line 21 wound in a plane. A plurality of coil wiring lines 21 are stacked in the axis direction. The coil wiring lines adjacent to each other in the stacking direction are electrically coupled in series through a via wiring line 26. In this manner, the plurality of coil wiring lines 21 are electrically coupled to each other in series so as to form a spiral. Specifically, the coil 20 has a configuration in which a plurality of coil wiring lines 21 each having less than 1 turn are electrically coupled to each other and stacked, and the coil 20 has a helical shape. Each coil wiring line 21 is composed of a coil conductor layer. In this regard, the coil wiring line 21 may be composed of a plurality of coil conductor layers that are stacked in face-to-face contact with each other. As a result, a coil wiring line 21 having a high aspect ratio and high rectangularity can be formed. The coil wiring line 21 may have a spiral shape with 1 turn or more.

The first direction-distinguishing layer 50 is disposed on the first surface 12 of the element assembly 10. The first direction-distinguishing layer 50 has a first cavity 51 passing through the first direction-distinguishing layer 50 in the thickness direction. The second direction-distinguishing layer 60 is disposed on the second surface 13 of the element assembly 10. The second direction-distinguishing layer 60 has a second cavity 61 passing through the second direction-distinguishing layer 60 in the thickness direction. Since the element assembly 10 is exposed to the outside through each of the first cavity 51 and the second cavity 61 as described above, heat generated inside the inductor component 1 can be efficiently dissipated to the outside during, for example, use of the inductor component 1. Consequently, the inductor component 1 has an excellent heat dissipation effect.

The shape of the first cavity 51 is substantially a quadrilateral when the inductor component 1 is viewed in the Y-direction. The shape of the second cavity 61 is the same quadrilateral as the shape of the first cavity 51.

In this regard, the shape of each of the first cavity 51 and the second cavity 61 may be, for example, a shape other than a quadrilateral. Examples of such a shape include substantially polygons other than a quadrilateral (more specifically, a triangle, a pentagon, and the like), a circle, and an ellipse.

Each of the first cavity 51 and the second cavity 61 may be composed of at least one of the same type of shapes. Alternatively, each of the first cavity 51 and the second cavity 61 may be composed of at least two different types of shapes. Each of the first cavity 51 and the second cavity 61 may be composed of, for example, at least two quadrilaterals. Alternatively, each of the first cavity 51 and the second cavity 61 may be composed of at least two types of shapes substantially selected from polygons (more specifically, a triangle, a quadrilateral, a pentagon, and the like), a circle, and an ellipse in combination.

The arrangement of these shapes may be changed. The shape, the arrangement, and the like of the second cavity 61 are the same as those of the first cavity 51 but may be different from those of the first cavity 51.

Regarding the first cavity 51, when the inductor component 1 is viewed in the Y-direction, the first cavity 51 may be apart from the outer edge of the first direction-distinguishing layer 50 or may be connected to the outer edge of the first direction-distinguishing layer 50.

Regarding the second cavity 61, in the same manner as the first cavity 51, when the inductor component 1 is viewed in the Y-direction, the second cavity 61 may be apart from the outer edge of the second direction-distinguishing layer 60 or may be connected to the outer edge of the second direction-distinguishing layer 60.

The shape of the cavity connected to the outer edge of the direction-distinguishing layer is, for example, a shape in which the shape of the cavity apart from the outer edge of the direction-distinguishing layer (specifically, a polygon, a circle, an ellipse, or the like) is in contact with or overlaps part of the outer edge of the first direction-distinguishing layer 50 or second direction-distinguishing layer 60. More specifically, regarding the shape, the first cavity 51 extends in both directions of the longitudinal direction (X-direction) and both end edges of the first cavity 51 overlap the respective outer edges of the first direction-distinguishing layer 50 in the X-direction. That is, regarding the shape, the first direction-distinguishing layer 50 is divided into two by a substantially rectangular first cavity 51 (groove-like shape). Alternatively, regarding the shape, the first cavity 51 extends in one direction of the longitudinal direction (X-direction) and one end edge of the first cavity 51 overlaps the outer edge of the first direction-distinguishing layer 50 in the X-direction. That is, regarding the shape, the first direction-distinguishing layer 50 takes the shape of substantially the letter U due to a substantially rectangular first cavity 51.

Figure 2:
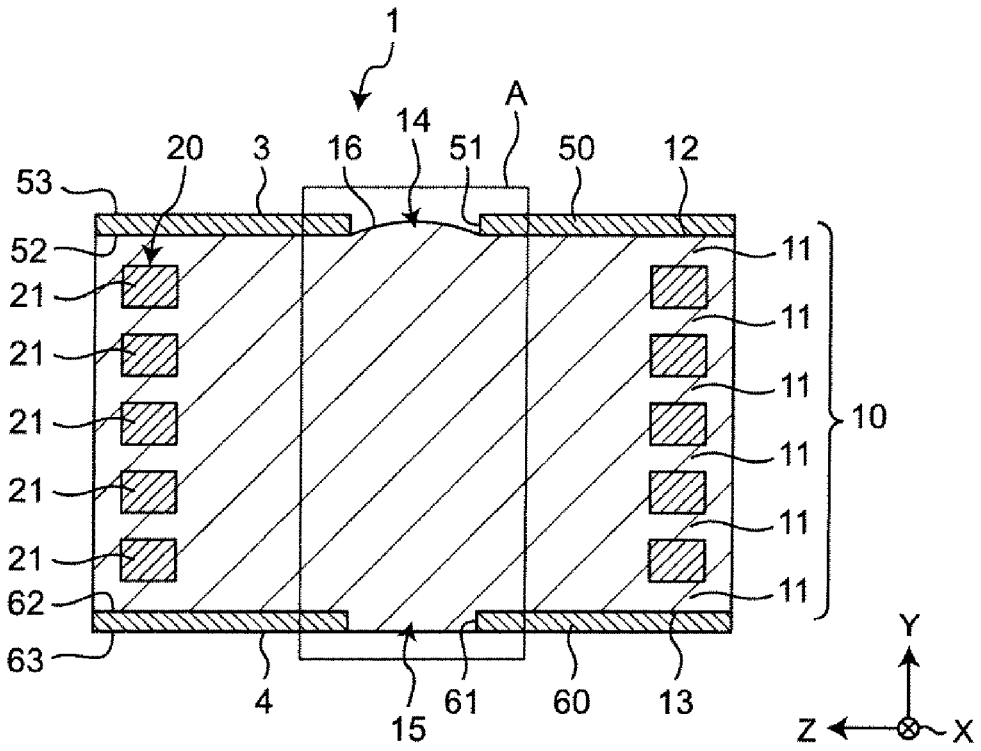
FIG. 2 is a sectional view of an inductor component.
Figure 3:
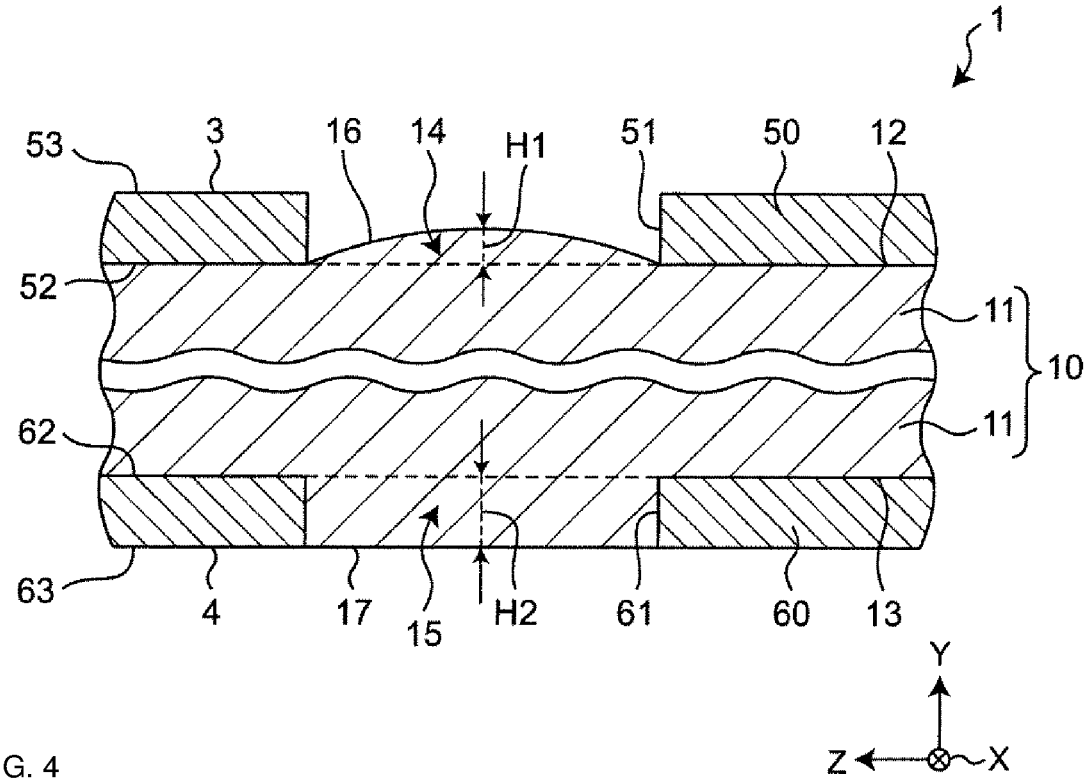
FIG. 3 is a diagram showing a magnified portion A in FIG. 2.

FIG. 2 is a YZ-sectional view of the inductor component 1. FIG. 3 is a diagram showing a magnified portion A in FIG. 2. As shown in FIG. 2 and FIG. 3, the element assembly 10 has the first surface 12 and the second surface located opposite to the first surface 12. The element assembly 10 includes a plurality of insulating layers 11. The plurality of insulating layers 11 are stacked in the Y-direction. In the element assembly 10, interfaces between two adjacent insulating layers may be indistinct due to firing or the like.

The coil wiring line 21 is formed by being wound on the principal surface (XY plane) of the insulating layer 11 orthogonal to the axis direction. The axis direction of the coil 20 and the stacking direction of the insulating layers 11 are the same direction.

The insulating layer 11 is a layer expanding in the XY plane orthogonal to the stacking direction that is the Y-direction. The insulating layer 11 contains an amorphous insulating layer base material and an insulating layer crystal. The insulating layer crystal is a filler having insulation performance and is preferably quartz (crystalline quartz). There is no particular limitation regarding the degree of crystallization of the quartz. Consequently, the refractive index of the insulating layer crystal can be reduced. The insulating layer base material is a solid having insulation performance. The insulating layer base material is an inorganic material such as glass and is preferably an amorphous glass, for example, a borosilicate glass containing B, Si, O, and K as primary components. In such a case, the element assembly 10 is a sintered body. As a result, an insulating layer having sufficient mechanical strength and insulation reliability can be obtained. In this regard, examples of the glass include, other than the borosilicate glass, glasses containing, for example, $SiO_2$, $B_2O_3$, $K_2O$, $Li_2O$, CaO, ZnO, $Bi_2O_3$, and/or $Al_2O_3$, such as $SiO_2$—$B_2O_3$—$K_2O$-based glasses, $SiO_2$—$B_2O_3$—$Li_2O$—CaO-based glasses, $SiO_2$—$B_2O_3$—$Li_2O$—CaO—ZnO-based glasses, and $Bi_2O_3$—$B_2O_3$—$SiO_2$—$Al_2O_3$-based glasses. At least two types of these glass components may be used in combination. Meanwhile, the insulating layer base material is not limited to being a glass and may be another inorganic material such as a ceramic material, for example, ferrite, or may be an organic material, for example, a resin. In this case, being amorphous is preferable. In the case in which the insulating layer base material is a resin, the element assembly 10 is a resin body. The resin is, for example, an epoxy resin or a fluororesin. Further, the above-described inorganic material and the organic material may be combined. In this regard, the insulating layer 11 may have a configuration in which no insulating layer crystal is contained. Of the above-described materials, materials having low permittivity and low dielectric loss are preferable. Meanwhile, in the case in which the insulating layer base material contains an insulating material, at least one of a first exposed portion 14 and a second exposed portion 15 may contain an insulating material.

The insulating layer 11 may further contain a metal material. In the case in which the insulating layer 11 contains a metal material, at least one of the first exposed portion 14 and the second exposed portion 15 may contain a metal material. Preferably, the metal material is a magnetic metal material. The element assembly 10 containing a magnetic metal material improves the magnetism of the inductor component 1.

The first direction-distinguishing layer 50 is disposed on the first surface 12 of the element assembly 10. The first direction-distinguishing layer 50 has a third surface 52 opposite the first surface 12 of the element assembly 10 and a fourth surface 53 located opposite to the third surface 52 with respect to the first direction-distinguishing layer 50. Meanwhile, the second direction-distinguishing layer 60 is disposed on the second surface 13 of the element assembly 10. The second direction-distinguishing layer 60 has a fifth surface 62 opposite the second surface 13 of the element assembly 10 and a sixth surface 63 located opposite to the fifth surface 62 with respect to the second direction-distinguishing layer 60.

Specifically, each of the first direction-distinguishing layer 50 and the second direction-distinguishing layer 60 is stacked outside the insulating layers 11 in the stacking direction. Each of the first direction-distinguishing layer 50 and the second direction-distinguishing layer 60 is disposed as the outermost layer of the inductor component 1 in the stacking direction of the insulating layers 11. Each of the first direction-distinguishing layer 50 and the second direction-distinguishing layer 60 is a layer expanding in the XZ plane orthogonal to the stacking direction that is the Y-direction. Each of the first direction-distinguishing layer 50 and the second direction-distinguishing layer 60 is visually distinguishable compared with the insulating layer 11, and favorable directional alignment of the inductor component 1 can be realized.

Each of the first direction-distinguishing layer 50 and the second direction-distinguishing layer 60 contains an amorphous direction-distinguishing layer base material and a direction-distinguishing layer crystal. The direction-distinguishing layer base material is the same as the insulating layer base material and is preferably an amorphous glass, for example, a borosilicate glass containing B, Si, O, and K as primary components. The direction-distinguishing layer crystal contains at least one type of crystalline pigment. Adding the pigment as described above enables the first direction-distinguishing layer 50 and the second direction-distinguishing layer 60 to be colored and enables the first direction-distinguishing layer 50 and the second direction-distinguishing layer 60 to have visibility (distinguishability). Preferably, the pigment is an oxide containing at least one of Ti, Co, Al, and Zr and is, for example, $CoAl_2O_2$ (cobalt blue) or $TiO_2$ (titania). Consequently, the first direction-distinguishing layer 50 and the second direction-distinguishing layer 60 that have favorable visibility can be obtained.

The first cavity 51 and the second cavity 61 may be located opposite to each other with respect to the element assembly 10. Specifically, in plan view in the Y-direction, the first cavity 51 and the second cavity 61 overlap one another or are preferably completely in accord with each other. The first cavity 51 and the second cavity 61 being completely in accord with each other in plan view in the Y-direction enables the outside air to pass through the inductor component 1 via the first cavity 51 and the second cavity 61. Therefore, degreasing performance of the inductor component 1 in the Y-direction is further improved. The first cavity 51 and the second cavity 61 being completely in accord with each other in plan view in the Y-direction enables the first direction-distinguishing layer 50 and the second direction-distinguishing layer 60 to have the same configuration.

The first cavity 51 and the second cavity 61 are arranged at positions that overlap the winding axis in plan view in the thickness direction of the first direction-distinguishing layer 50. That is, the first cavity 51 and the second cavity 61 exist on the winding axis of the coil 20. In such a case, since the magnetic flux of the coil passes through the first cavity 51 and the second cavity 61, the magnetic flux passes through neither the first direction-distinguishing layer 50 nor the second direction-distinguishing layer 60. Consequently, the magnetic flux is not blocked regardless of the material for forming the first direction-distinguishing layer 50 and the second direction-distinguishing layer 60, and the Q-value of the inductor component 1 is suppressed from being reduced.

The element assembly 10 has, on the first surface 12, the first exposed portion 14 that is the element assembly 10 exposed in the first cavity 51 and has, on the second surface 13, a second exposed portion 15 that is the element assembly 10 exposed in the second cavity 61. The first amount of protrusion H1 of the first exposed portion 14 protruding in the thickness direction of the first direction-distinguishing layer 50 is less than the second amount of protrusion H2 of the second exposed portion 15 protruding in the thickness direction of the second direction-distinguishing layer 60.

In the present specification, "first amount of protrusion" H1 denotes the maximum height of the first exposed portion 14 from the first surface 12 in the vertical direction. Regarding the first amount of protrusion H1, the first surface 12 is specified as the reference (zero: the broken line in the Z-direction of the first exposed portion 14 shown in FIG. 3), the positive side is specified to be from the first surface 12 toward the first cavity 51, and the negative side is specified to be from the first surface 12 toward the second direction-distinguishing layer 60. In FIG. 3, the shape of the first exposed portion 14 is a shape with a peak (apex) at the top (direction of the arrow indicating the Y-direction). The first amount of protrusion H1 is the distance from the first surface 12 to the peak of the first exposed portion 14. The first amount of protrusion H1 may be adjusted by, for example, a method in which a force is applied to a multilayer body in the Y-direction in the method for manufacturing the inductor component 1 described later. Alternatively, the first amount of protrusion H1 may be adjusted by, for example, embedding a material (more specifically, alumina, a resin, and the like) that burns off during firing treatment described later into the first cavity 51.

In this regard, the first amount of protrusion H1 may take on a value of 0 or less. The first amount of protrusion H1 and the second amount of protrusion H2 are calculated by using a laser microscope ("VK-X Series" produced by KEYENCE CORPORATION, magnification of 20 times) and by subjecting the first exposed surface and the second exposed surface to measurement.

In the present specification, "the first exposed portion 14 that is exposed in the first cavity 51 on the first surface 12" denotes a portion of the first surface 12 that can be visually identified through the first cavity 51 in plan view of the inductor component 1 when viewed from the first direction-distinguishing layer 50 side in the Y-direction. Therefore, as described above, the first exposed portion 14 may have a shape with a peak (apex) at the top (direction of the arrow indicating the Y-direction) with respect to the reference. In such a case, the first amount of protrusion H1 takes on a value more than 0. Meanwhile, the first exposed portion 14 may have a shape with a peak (apex) at the bottom (opposite direction of the arrow indicating the Y-direction) with respect to the reference. In such a case, the first amount of protrusion H1 takes on a value less than 0. In this regard, the first exposed portion 14 includes an exposed surface 16 of the first exposed portion 14.

In the present specification, "second amount of protrusion" H2 denotes the maximum height of the second exposed portion 15 from the second surface 13 in the vertical direction. Regarding the second amount of protrusion H2, the second surface 13 is specified as the reference (zero: the broken line in the Z-direction of the second exposed portion 15 shown in FIG. 3), the positive side is specified to be from the second surface 13 toward the second cavity 61, and the negative side is specified to be from the second surface 13 toward the first direction-distinguishing layer 50. In FIG. 3, the shape of the second exposed portion 15 is substantially a quadrilateral. An exposed surface 17 of the second exposed portion 15 is flush with the sixth surface 63 of the second direction-distinguishing layer 60. That is, the second amount of protrusion H2 is equal to the thickness of the second direction-distinguishing layer 60, and the second side surface 4 of the inductor component 1 becomes level. The level surface may be realized by, for example, forming the layers from the second direction-distinguishing layer 60 to the first direction-distinguishing layer 50 by stacking in the method for manufacturing the inductor component described later. The second amount of protrusion H2 may be adjusted by, for example, embedding a material (more specifically, alumina, a resin, and the like) that burns off during firing treatment described later into the second cavity 61.

In this regard, the second amount of protrusion H2 may take on a value more than 0. In the present specification, "flush" is not limited to strictly flush and includes substantially flush in consideration of a practical range of variations.

In the present specification, "the second exposed portion 15 that is exposed in the second cavity 61 on the second surface 13" denotes a portion of the second surface 13 that can be visually identified through the second cavity 61 in plan view of the inductor component 1 when viewed from the second direction-distinguishing layer 60 side in the Y-direction. Therefore, as described above, the second exposed portion 15 may have a shape protruding upward (direction of the arrow indicating the Y-direction) with respect to the reference. In such a case, the second amount of protrusion H2 takes on a value more than 0. Meanwhile, the second exposed portion 15 may have a shape protruding downward (opposite direction of the arrow indicating the Y-direction) with respect to the reference. In such a case, the second amount of protrusion H2 takes on a value less than 0. In this regard, the second exposed portion 15 includes an exposed surface 17 of the second exposed portion 15.

When the first amount of protrusion H1 is less than the second amount of protrusion H2, the element assembly 10 includes the first exposed portion 14 and the second exposed portion 15 having different amounts of protrusion. Therefore, the first direction-distinguishing layer 50 and the second direction-distinguishing layer 60 can be visually distinguished with ease and with reliability. Consequently, the first direction-distinguishing layer 50 and the second direction-distinguishing layer 60 that are visually distinguishable from each other in spite of the materials having the same composition can be formed. As a result, the direction distinguishability of the inductor component 1 can be readily improved. Consequently, the inductor component can be reliably mounted in an appropriate orientation, and predetermined inductance can be acquired.

Method for manufacturing inductor component

Next, an example of the method for manufacturing the inductor component 1 will be described.

A direction-distinguishing layer paste that contains a pigment and that contains a borosilicate glass powder as a primary component is prepared. The pigment is an oxide containing at least one element of Ti, Co, Al, and Zr and is, for example, $CoAl_2O_2$ (cobalt blue) or $TiO_2$ (titania). In addition, an insulating paste that contains a crystal such as quartz as a filler and that contains a borosilicate glass powder as a primary component and a conductive paste that contains Ag as a metal primary component are prepared. After firing described later, the direction-distinguishing layer paste becomes the first direction-distinguishing layer 50 and the second direction-distinguishing layer 60, and the insulating paste becomes the insulating layer 11. At this time, the insulating layer 11 contains an insulating layer base material that is an amorphous borosilicate glass and an insulating layer crystal that is a filler. The first direction-distinguishing layer 50 and the second direction-distinguishing layer 60 contain a direction-distinguishing layer base material that is an amorphous borosilicate glass and a direction-distinguishing layer crystal that is a pigment. The conductive paste becomes a conductive paste layer. The conductive paste layer serves as a coil wiring conductor paste layer, a via wiring conductor paste layer, or an outer electrode conductor paste layer in accordance with the position of coating. These layers become a coil conductor layer, a via wiring conductor layer, or an outer electrode conductor layer, respectively, due to firing described later. The conductive paste may contain Cu or Au instead of Ag serving as the metal primary component. In the present manufacturing method, since a photolithography method is used, the direction-distinguishing layer paste, the insulating paste, and the conductive paste have photosensitivity. In the photolithography method, coating is performed with a photomask, formed paste layers (insulating paste layer, direction-distinguishing paste layer, and conductive paste layer) are irradiated with ultraviolet rays or the like so as to perform exposure, and development is performed with an alkali solution or the like. In this regard, as described above, since the first direction-distinguishing layer and the second direction-distinguishing layer can be distinguished on the basis of the difference between the first amount of protrusion H1 of the first exposed portion 14 and the second amount of protrusion H2 of the second exposed portion 15, there is no need to prepare two types of direction-distinguishing layer pastes having different pigment concentrations. Consequently, the cost and the number of steps can be reduced.

Subsequently, a lowermost layer is formed by coating a carrier film with an appropriate amount of direction-distinguishing layer paste by screen printing. The lowermost layer is a portion serving as the second direction-distinguishing layer 60 (second direction-distinguishing paste layer). The second cavity 61 is formed in the lowermost layer through a patterning step by using the photolithography method.

The lowermost layer is coated with an appropriate amount of insulating paste by screen printing so as to form a portion serving as the insulating layer 11 (insulating paste layer). At this time, the insulating paste enters the second cavity 61, and the second cavity 61 is filled. The insulating paste layer serves as an outer-layer insulating layer located outside the coil wiring line 21.

The applied insulating paste is coated with an appropriate amount of conductive paste by screen printing, and a coil wiring conductor paste layer serving as a coil conductor layer, an outer electrode conductor paste layer serving as an outer electrode conductor layer, and an extended electrode conductor paste layer serving as an extended electrode conductor layer are formed through a patterning step by using the photolithography method. At this time, the shortest distance between the outer circumferential edge of the coil wiring conductor paste layer and the outer edge (outer edge formed in a cutting step performed thereafter) of the insulating paste layer is set to be less than the width of the outer electrode conductor paste layer.

The insulating paste layer provided with the conductive paste that is applied and patterned is coated with an appropriate amount of insulating paste by screen printing. Further, an opening and a via hole are formed in the insulating paste layer through a patterning step by using the photolithography method.

The insulating paste layer having the opening and the via hole is coated with an appropriate amount of conductive paste by screen printing. At this time, a via wiring conductor paste layer and an outer electrode conductor paste layer are formed by filling the opening and the via hole with the conductive paste. In addition, in the same manner as above, a coil wiring conductor paste layer, an extended electrode conductor paste layer, and an outer electrode conductor paste layer are formed through a patterning step by using the photolithography method.

The above-described steps are repeated so as to further form each of the insulating paste layer, the coil wiring conductor paste layer, the via wiring conductor paste layer, the extended electrode conductor paste layer, and the outer electrode conductor paste layer.

Applying appropriate amounts of the insulating paste and the direction-distinguishing layer paste in this order by screen printing is repeated so as to form an upper-layer-side insulating paste layer and a first direction-distinguishing paste layer serving as the uppermost layer. The first cavity 51 is formed in the uppermost layer through a patterning step by using the photolithography method. The shape of a portion corresponding to the first exposed portion 14 can be controlled by adjusting the exposure conditions (more specifically, an amount of exposure and the like) and development conditions (more specifically, a development time, the type of developing solution, and the like) during the patterning step. The upper-layer-side insulating paste layer is an outer-layer insulating paste layer located outside the coil wiring line conductor paste layer. After the first cavity 51 is formed, a force is applied to the multilayer body from the first direction-distinguishing paste layer toward the second direction-distinguishing paste layer (in the reverse Y-direction). As a result, the shape of the portion corresponding to the first exposed portion 14 becomes a shape with a peak (apex) at the top (forward Y-direction).

A mother multilayer body is obtained through the above-described steps. In this regard, the mother multilayer body is formed so that a plurality of portions serving as the inductor components 1 are arranged in a matrix. The mother multilayer body is cut into a plurality of unfired multilayer bodies with a dicing machine or the like. In the cutting step of the mother multilayer body, the outer electrode conductor layer of the multilayer body is exposed at the cut surface formed by cutting.

The unfired multilayer body is fired under a predetermined condition so as to obtain the element assembly 10 in which the first direction-distinguishing layer 50, the second direction-distinguishing layer 60, the insulating layer 11, the coil wiring line 21, the via wiring line 26, the extended electrode 22, the first outer electrode 30, and the second outer electrode 40 are formed. The resulting element assembly 10 is a sintered body, and sintering is performed while part of the surface of the element assembly 10 before sintering is exposed to air. Consequently, gases (specifically, organic materials contained in the element assembly 10 before sintering, decomposition products thereof, oxidation products thereof, and the like) generated during sintering are readily released, and degreasing performance is improved. Further, a heat dissipation effect during sintering is excellent.

The element assembly 10 is further subjected to barrel finishing. Thereafter, Ni plating having a thickness of about 2 μm to 10 μm and Sn plating having a thickness of about 2 μm to 10 μm are formed by barrel plating on a portion at which each of the first outer electrode 30 and the second outer electrode 40 of the element assembly 10 is exposed. The inductor component 1 having a size of about 0.4 mm×0.2 mm×0.2 mm is obtained through the above-described steps.

When the inductor component 1 is produced by, for example, the above-described manufacturing method, the exposed surface 17 of the second exposed portion 15 becomes flush with the sixth surface 63 of the second direction-distinguishing layer 60. The reason is as described below. The portion serving as the second direction-distinguishing layer 60 before sintering is arranged on the carrier film and has the second cavity 61. In this state, the second direction-distinguishing layer 60 is coated with the insulating paste a plurality of times. Since the bottom surface of the second cavity 61 is blocked by the carrier film and the insulating paste enters the second cavity 61 due to the weight of the plurality of insulating pastes, the second cavity 61 is filled with the insulating paste. When firing is performed in this state, the exposed surface 17 of the second exposed portion 15 becomes flush with the sixth surface 63 of the second direction-distinguishing layer 60.

In this regard, forming the direction-distinguishing paste layer, the insulating paste layer, and the conductive paste layer is not limited to the above-described screen printing and patterning by using the photolithography method. For example, a printing lamination method in which printing by using a screen plate having a cavity and forming an opening by using laser or drilling are repetitively performed may be adopted or a sheet stacking method in which a plurality of sheets are formed by performing the printing and the forming an opening on a layer basis and the resulting sheets are pressure-bonded may be adopted. Meanwhile, the coil wiring line 21, the extended electrode 22, the via wiring line 26, the first outer electrode 30, and the second outer electrode 40 may be formed by a method in which a conductor film (more specifically, a conductor film containing Ag, Cu, or Au) formed by a sputtering method, an evaporation method, pressure bonding of foil, or the like without using the conductor paste is patterned by etching or by a method in which a negative pattern is formed of a resist on a seed layer of a conductor, a conductor is further formed in a cavity of the resist by plating, and unnecessary portions of the resist and the seed layer are removed as in a semiadditive method.

Further, the portion serving as the coil wiring line 21 having a high aspect ratio due to multi-step formation enables loss caused by resistance at high frequencies to be reduced. More specifically, a process in which forming the conductive paste layer by using the photolithography method and patterning are repeated may be adopted, a pattern in which conductor films formed by using the semiadditive method are repetitively stacked may be adopted, or a process in which part of the stacking is formed by plating growth may be adopted.

Each material is not limited to the above-described examples and known materials may be used. In particular, magnetic materials may be used for the first direction-distinguishing layer 50, the second direction-distinguishing layer 60, and the insulating layer 11.

The insulating material is not limited to the above-described glasses and may be ceramic materials, for example, ferrite. Meanwhile, element assemblies composed of resin bodies may be produced by using organic materials such as epoxy resins and fluororesins as the insulating materials. Further, the insulating materials may be composite materials such as glass epoxy resins. Of these, materials having lower permittivity and lower dielectric loss are preferable.

The size of the inductor component 1 is not limited to about 0.4 mm×0.2 mm×0.2 mm and may be, for example, about 0.6 mm×0.3 mm×0.3 mm or about 0.2 mm×0.1 mm×0.1 mm. The length in the Y-direction is not limited to being equal to the length in the Z-direction, and the size may be about 0.4 mm×0.2 mm×0.3 mm or the like.

The method for manufacturing the first outer electrode 30 and the second outer electrode 40 is not limited to a method in which the first outer electrode 30 and the second outer electrode 40 embedded in the element assembly 10 are exposed by cutting and are subjected to plating, and may be a method in which the first outer electrode 30 and the second outer electrode 40 are not embedded in the element assembly 10, but the first outer electrode 30 and the second outer electrode 40 may be formed by performing dipping into the conductive paste, sputtering, or the like after cutting and, subsequently, plating may be performed thereon.

Second Embodiment

Figure 4:
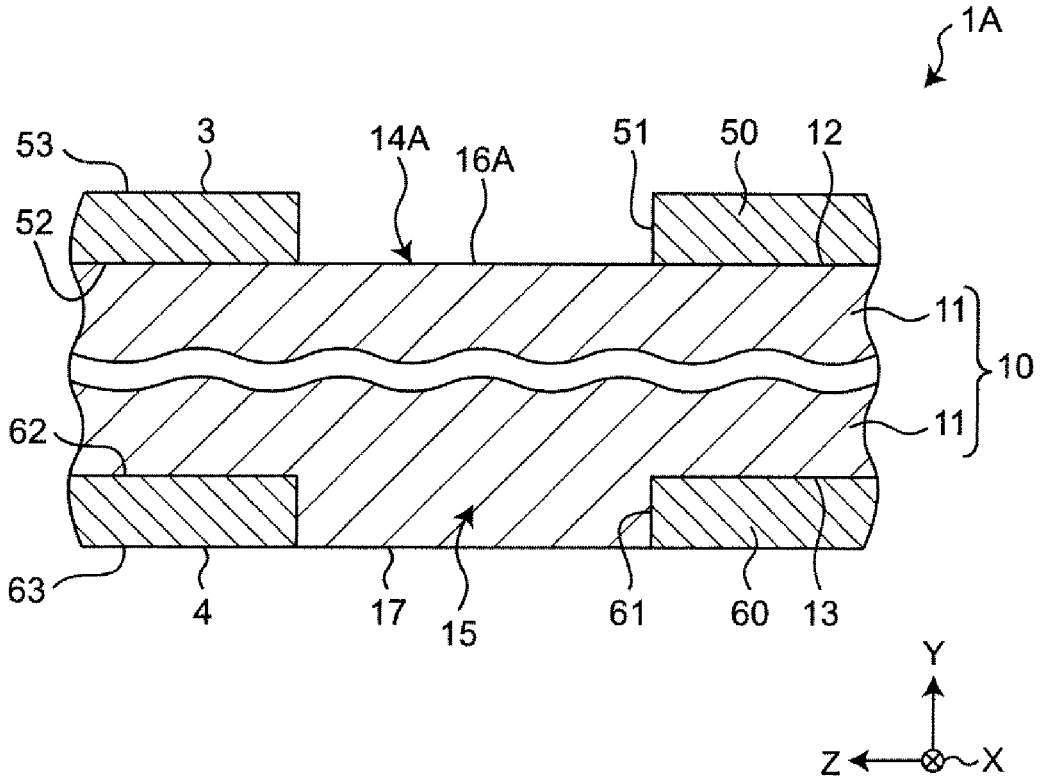
FIG. 4 is a magnified sectional view showing a second embodiment of the inductor component according to an aspect of the present disclosure.

FIG. 4 is a magnified sectional view showing a second embodiment of the inductor component. FIG. 4 shows a modified example of the first embodiment shown in FIG. 3. The second embodiment is different from the first embodiment in that an exposed surface 16A of a first exposed portion 14A is flush with the third surface 52 of the first direction-distinguishing layer 50. The configuration related to this difference will be described below. In the second embodiment, the same references as in the first embodiment indicate the same configurations as in the first embodiment, and explanations thereof are omitted.

Configuration

As shown in FIG. 4, in the inductor component 1A of the second embodiment, the exposed surface 16A of the first exposed portion 14A is flush with the third surface 52 of the first direction-distinguishing layer 50, and the exposed surface 17 of the second exposed portion 15 is flush with the sixth surface 63 of the second direction-distinguishing layer 60. The first amount of protrusion H1 is 0.

The exposed surface 16A of the first exposed portion 14A is flush with the surface of the first direction-distinguishing layer 50 in contact with the first surface 12. Specifically, the exposed surface 16A of the first exposed portion 14A is flush with the third surface 52 of the first direction-distinguishing layer 50. That is, the first cavity 51 is not filled with the element assembly 10. Consequently, the surface area of the surface (first side surface 3) of the inductor component 1A on the first direction-distinguishing layer 50 side is greater than the surface area of an inductor component in which a direction-distinguishing layer has no cavity by the side surface (inner surface) of the first cavity 51. As a result, during use of the inductor component 1A, heat generated inside the inductor component 1A can be efficiently dissipated outside the inductor component 1A. Therefore, the heat dissipation effect of the inductor component 1A is further improved.

The exposed surface 17 of the second exposed portion 15 is flush with the surface of the second direction-distinguishing layer 60. Specifically, the exposed surface 17 of the second exposed portion 15 is flush with the sixth surface 63 of the second direction-distinguishing layer 60. That is, the second cavity 61 is entirely filled with the element assembly 10. On the other hand, the surface (first side surface 3) of the inductor component 1A on the first direction-distinguishing layer 50 side has the first cavity 51 not filled with the element assembly 10, as described above. In this manner, since the first exposed portion 14A and the second exposed portion 15 have shapes that are significantly different from each other, the first direction-distinguishing layer 50 and the second direction-distinguishing layer 60 can be distinguished from each other with ease and with reliability. Consequently, the direction distinguishability of the inductor component 1A is further readily improved.

Method for Manufacturing Inductor Component

The inductor component 1A may be produced by, for example, skipping the treatment to apply a force after forming the first cavity 51 in the above-described method for manufacturing the inductor component 1.

Meanwhile, the method for manufacturing the inductor component 1A further includes the step of curing an outer-layer insulating paste layer in the above-described method for manufacturing the inductor component 1, for example. In the step of curing an outer-layer insulating paste layer, after the outer-layer insulating paste layer is formed and before a first direction-distinguishing paste layer is formed, the outer-layer insulating paste layer is subjected to drying treatment or pre-firing treatment so as to cure the outer-layer insulating paste layer to some extent. Consequently, even when the first direction-distinguishing paste layer is formed on the outer-layer insulating paste layer subjected to the drying treatment or the pre-firing treatment, the portion corresponding to the first exposed portion 14A does not have a shape with a peak in the forward Y-direction in spite of the weight of the first direction-distinguishing paste layer. As a result, the exposed surface 16A of the first exposed portion 14A becomes flush with the third surface 52 of the first direction-distinguishing layer 50.

Third Embodiment

Figure 5:
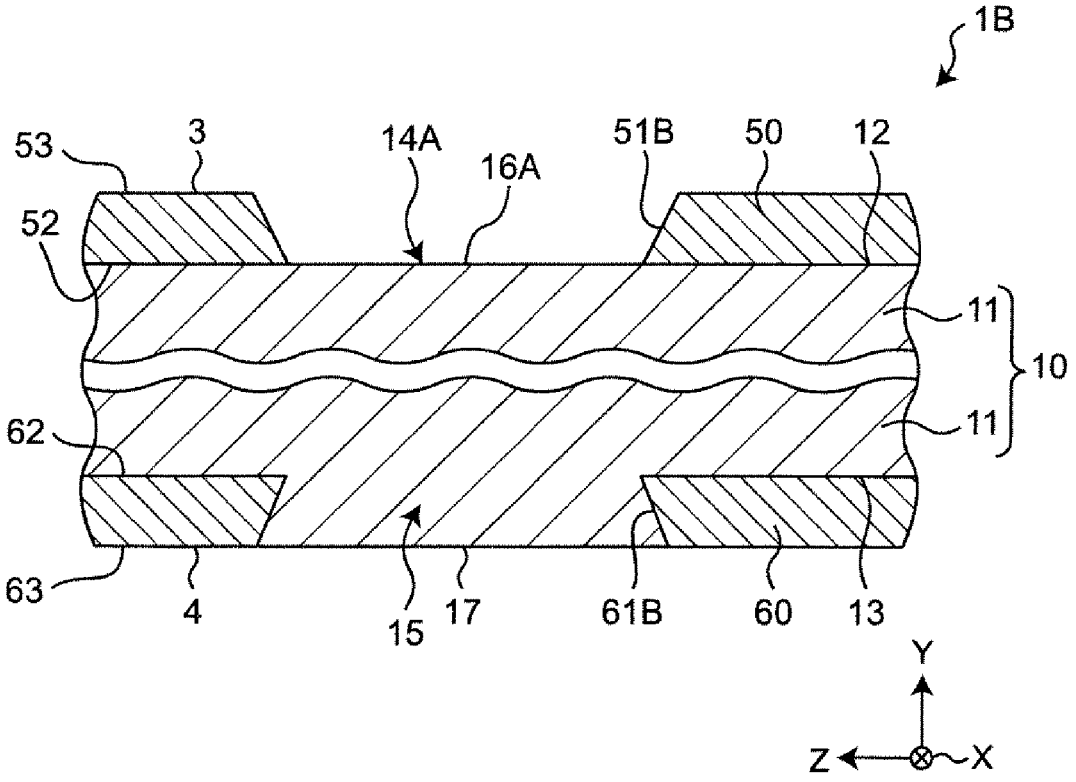
FIG. 5 is a magnified sectional view showing a third embodiment of the inductor component according to an aspect of the present disclosure.

FIG. 5 is a magnified sectional view showing a third embodiment of the inductor component. FIG. 5 shows a modified example of the first embodiment shown in FIG. 3. The third embodiment is different from the second embodiment in the cross-sectional shape of a first cavity 51B. The configuration related to this difference will be described below. In the third embodiment, the same references as in the first embodiment and the second embodiment indicate the same configurations as in the first embodiment and the second embodiment, and explanations thereof are omitted.

Configuration

As shown in FIG. 5, in the inductor component 1B of the third embodiment, the inner surface of the first cavity 51B is inclined such that the inner diameter of the first cavity 51B increases from the third surface 52 of the first direction-distinguishing layer 50 toward the fourth surface 53. That is, the first cavity 51B has a tapered shape.

Since the inner surface of the first cavity 51B is inclined such that the inner diameter of the first cavity 51B increases from the third surface 52 toward the fourth surface 53, the surface area of the surface (first side surface 3) of the inductor component 1B on the first direction-distinguishing layer 50 side increases in accordance with inclination of the inner surface. As a result, heat generated inside the element assembly 1B is readily dissipated outside the inductor component 1B via the inner surface.

The inner surface of the first cavity 51B is inclined such that the inner diameter of the first cavity 51B increases from the third surface 52 toward the fourth surface 53. That is, the outer-side opening of the first cavity 51B is larger. Consequently, the heat released from inside the inductor component 1B into the first cavity 51B readily released outside the inductor component 1B.

Further, since the inner surface of the first cavity 51B is inclined such that the inner diameter of the first cavity 51B increases from the third surface 52 toward the fourth surface 53, the heat released from the inner surface does not readily retain in the first cavity 51B.

Therefore, the heat generated inside the element assembly 1B is efficiently dissipated outside the inductor component 1B during use of the inductor component 1B, for example. In such a case, the element assembly 10 being a sintered body improves degreasing performance and a heat dissipation effect during sintering.

In the inductor component 1B of the third embodiment, the inner surface of the second cavity 61B is inclined such that the inner diameter of the second cavity 61B increases from the fifth surface 62 of the second direction-distinguishing layer 60 toward the sixth surface 63. That is, the second cavity 61B has a tapered shape. Meanwhile, the second amount of protrusion H2 is more than 0. The second cavity 61B is filled with the element assembly 10.

Since the inner surface of the second cavity 61B is inclined such that the inner diameter of the second cavity 61B increases from the fifth surface 62 toward the sixth surface 63, the area of the inner surface (inclined surface) of the second direction-distinguishing layer 60 of the inductor component 1B increases in accordance with inclination of the inner surface. As a result, the contact area between the second direction-distinguishing layer 60 and the element assembly 10 increases. Consequently, the adhesiveness between the element assembly 10 and the second direction-distinguishing layer 60 is improved, and the second direction-distinguishing layer 60 is suppressed from peeling from the element assembly 10. Therefore, in the present embodiment, the direction distinguishability is suppressed from being deteriorated.

In addition, since the second cavity 61B has a tapered shape, the second direction-distinguishing layer 60 is suppressed from peeling from the element assembly 10 due to an anchor effect. Therefore, in the present embodiment, the direction distinguishability is suppressed from being deteriorated.

Meanwhile, the inner surface of the first cavity may be inclined such that the inner diameter of the first cavity decreases from the third surface 52 toward the fourth surface 53. That is, the first cavity may have a reverse tapered shape. The first cavity having a reverse tapered shape increases the surface area of the first side surface of the inductor component in accordance with inclination of the inner surface. As a result, heat generated inside the inductor component can be further efficiently dissipated outside the inductor component during use of the inductor component.

Meanwhile, the inner surface of the second cavity may be inclined such that the inner diameter of the second cavity decreases from the fifth surface 62 toward the sixth surface 63. That is, the second cavity may have a reverse tapered shape. The second cavity having a reverse tapered shape further improves an anchor effect and suppresses the second direction-distinguishing layer from peeling.

Method for Manufacturing Inductor Component

In the method for manufacturing the inductor component 1B, the aspect in which the inner surface of the first cavity 51B is inclined may be realized by, for example, adjusting the amount of exposure (exposure intensity) during forming the first cavity 51B in the first direction-distinguishing layer 50 by using a photolithography method. Further, the aspect of having a tapered shape may be realized by adjusting the amount of exposure to a relatively small level by using a negative resist. The aspect of having a reverse tapered shape may be realized by adjusting the amount of exposure to a relatively small level by using a positive resist.

The above-described production conditions in the first embodiment to the third embodiment are just examples, and there is no particular limitation regarding the production conditions provided that the first amount of protrusion H1 is less than the second amount of protrusion H2.

The present disclosure is not limited to the first embodiment to the third embodiment and may be realized in various forms within the effect of the present disclosure. In this regard, the configurations shown in the first embodiment to the third embodiment are examples and are not specifically limited. The configurations may be variously changed substantially within the effect of the present disclosure. For example, the items described in the first embodiment to the third embodiment may be appropriately combined. For example, the configuration described in the first embodiment may be combined with the configuration described in the third embodiment in which the inner surface of the first cavity MB is inclined.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component, comprising: a mold portion having a first surface and a second surface opposing each other in a thickness direction;

a winding coil disposed on the second surface of the mold portion;

a cover portion disposed on the mold portion and the winding coil; and accommodating grooves disposed on the first surface of the mold portion and spaced apart from each other in a longitudinal direction of the coil component perpendicular to the thickness direction, both ends of the winding coil being disposed in the accommodating grooves, respectively, wherein an accommodating groove of the accommodating grooves extends from one side of the mold portion in a width direction perpendicular to the thickness and longitudinal directions, and the accommodating groove includes inclined surfaces, angled with respect to the width direction, extending from one end to the other end of the accommodating groove, such that a minimum distance from the accommodating groove to the second surface of the mold portion, in the thickness direction of the molded portion and the winding coil, increases in the width direction.

2. The inductor component according to claim 1, wherein at least one of the first exposed portion and the second exposed portion contains an insulating material.

3. The inductor component according to claim 1, wherein at least one of the first exposed portion and the second exposed portion contains a metal material.

4. The inductor component according to claim 1, further comprising a coil that is disposed in the element assembly and that has a winding axis in the thickness direction of the first direction-distinguishing layer, wherein each of the first cavity and the second cavity is formed at a position overlapping the winding axis in plan view when viewed in the thickness direction of the first direction-distinguishing layer.

5. The inductor component according to claim 1, wherein the element assembly is a sintered body.

6. The inductor component according to claim 1, wherein the element assembly is a resin body.

7. The inductor component according to claim 1, wherein the exposed surface of the second exposed portion is flush with the surface of the second direction-distinguishing layer.

8. The inductor component according to claim 1, wherein the exposed surface of the first exposed portion is flush with the surface of the first direction-distinguishing layer in contact with the first surface.

9. The inductor component according to claim 1, wherein the first direction-distinguishing layer has a third surface opposite the first surface of the element assembly and a fourth surface located opposite to the third surface with respect to the first direction-distinguishing layer, and the inner surface of the first cavity is inclined such that the inner diameter of the first cavity increases from the third surface toward the fourth surface.

10. The inductor component according to claim 1, wherein the second amount of protrusion is more than 0, the second direction-distinguishing layer has a fifth surface opposite the second surface of the element assembly and a sixth surface located opposite to the fifth surface with respect to the second direction-distinguishing layer, and the inner surface of the second cavity is inclined such that the inner diameter of the second cavity increases from the fifth surface toward the sixth surface.

11. The inductor component according to claim 2, wherein at least one of the first exposed portion and the second exposed portion contains a metal material.

12. The inductor component according to claim 2, further comprising a coil that is disposed in the element assembly and that has a winding axis in the thickness direction of the first direction-distinguishing layer, wherein each of the first cavity and the second cavity is formed at a position overlaping the winding axis in plan view when viewed in the thickness direction of the first direction-distinguishing layer.

13. The inductor component according to claim 3, further comprising a coil that is disposed in the element assembly and that has a winding axis in the thickness direction of the first direction-distinguishing layer, wherein each of the first cavity and the second cavity is formed at a position overlaping the winding axis in plan view when viewed in the thickness direction of the first direction-distinguishing layer.

14. The inductor component according to claim 2, wherein the element assembly is a sintered body.

15. The inductor component according to claim 3, wherein the element assembly is a sintered body.

16. The inductor component according to claim 2, wherein the element assembly is a resin body.

17. The inductor component according to claim 2, wherein the exposed surface of the second exposed portion is flush with the surface of the second direction-distinguishing layer.

18. The inductor component according to claim 2, wherein the exposed surface of the first exposed portion is flush with the surface of the first direction-distinguishing layer in contact with the first surface.

19. The inductor component according to claim 2, wherein the first direction-distinguishing layer has a third surface opposite the first surface of the element assembly and a fourth surface located opposite to the third surface with respect to the first direction-distinguishing layer, and the inner surface of the first cavity is inclined such that the inner diameter of the first cavity increases from the third surface toward the fourth surface.

20. The inductor component according to claim 2, wherein the second amount of protrusion is more than 0, the second direction-distinguishing layer has a fifth surface opposite the second surface of the element assembly and a sixth surface located opposite to the fifth surface with respect to the second direction-distinguishing layer, and the inner surface of the second cavity is inclined such that the inner diameter of the second cavity increases from the fifth surface toward the sixth surface.

* * * * *